US007424893B2

(12) United States Patent
Kim

(10) Patent No.: US 7,424,893 B2
(45) Date of Patent: Sep. 16, 2008

(54) DISHWASHER

(75) Inventor: Yong Hee Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 639 days.

(21) Appl. No.: 10/721,182

(22) Filed: Nov. 26, 2003

(65) Prior Publication Data

US 2004/0103932 A1 Jun. 3, 2004

(30) Foreign Application Priority Data

Nov. 28, 2002 (KR) ..... 10-2002-0075062

(51) Int. Cl.
*A47L 15/50* (2006.01)
*B08B 3/00* (2006.01)

(52) U.S. Cl. ..... 134/137; 211/207; 211/98; 312/351

(58) Field of Classification Search ..... 134/56 D, 134/137; 211/41.8, 41.9, 207, 98; 312/228, 312/228.1, 311, 351
See application file for complete search history.

(56) References Cited

U.S. PATENT DOCUMENTS

| | | | | |
|---|---|---|---|---|
| 3,560,069 | A * | 2/1971 | Doepke | 312/351 |
| 3,726,580 | A * | 4/1973 | Guth | 312/351 |
| 3,726,581 | A * | 4/1973 | Doepke | 312/351 |
| 3,768,883 | A * | 10/1973 | Kauffman | 312/351 |
| 3,822,085 | A * | 7/1974 | Clark | 312/351 |
| 4,097,099 | A * | 6/1978 | Spiegel | 312/311 |
| 4,138,173 | A * | 2/1979 | Taniwaki | 312/198 |
| 5,657,878 | A * | 8/1997 | Austin | 211/41.8 |
| 5,860,716 | A * | 1/1999 | Good et al. | 312/311 |
| 6,247,771 | B1 * | 6/2001 | Miller | 312/310 |
| 6,755,490 | B2 * | 6/2004 | Welch et al. | 312/228.1 |
| 2003/0075517 | A1 * | 4/2003 | Jahrling | 211/41.8 |

FOREIGN PATENT DOCUMENTS

| | | | |
|---|---|---|---|
| DE | 19954471 | A1 * | 5/2001 |
| EP | 0033483 | * | 1/1981 |
| EP | 901770 | A2 * | 3/1999 |
| EP | 1161917 | A2 * | 12/2001 |
| WO | WO 02/49495 | A1 * | 6/2002 |

* cited by examiner

*Primary Examiner*—Michael Barr
*Assistant Examiner*—Jason P Riggleman
(74) *Attorney, Agent, or Firm*—Ked & Associates LLP

(57) ABSTRACT

A dishwasher is disclosed, by which an installation height of a rack is adjusted inside a washing chamber and in which the installation height is automatically adjusted by a button. The dishwasher includes a washing chamber having tableware washed therein, a rack movably installed in the washing chamber to hold the tableware thereon, a plurality of guide rollers fixed to both confronting sidewalls of the washing chamber, a guide rail provided between the plurality of guide rollers to slide back and forth, and a height adjustment device configured to move the rack upward and downward, the height adjust device being provided to slide on the guide rail.

20 Claims, 13 Drawing Sheets

DISHWASHER

This application claims the benefit of Korean Application(s) No. 10-2002-0075062 filed on Nov. 28, 2002, which is/are hereby incorporated by reference.

BACKGROUND OF THE INVENTION

1. Field of the Invention

The present invention relates to a dishwasher.

2. Discussion of the Related Art

Generally, a dishwasher is an apparatus for automatically washing and drying tableware by injecting water and detergent on the tableware. A dishwasher according to a related art is explained by referring to the attached drawings.

FIG. 1 is a perspective view of a dishwasher according to a related art and FIG. 2 is a cross-sectional view of a rack assembly of a dishwasher according to a related art.

Referring to FIG. 1 and FIG. 2, a dishwasher according to a related art mainly consists of a cabinet 4 having a large open front side, a washing chamber 2 provided in the cabinet 4, and a door 6 opening closing the open front side of the cabinet 4.

Upper and lower racks 10 and 12 on which tableware is put are provided in the washing chamber 2, and top and bottom nozzles 14 and 16 injecting water via injection holes are rotatably provided under the upper and lower racks 10 and 12, respectively.

A sump (not shown in the drawing) is provided under the washing chamber 2 to collect water therein. A pump (not shown in the drawing) pumping water to the top and bottom nozzles 14 and 16 and a heater assembly (not shown in the drawing) for heating water held in the sump are provided in the sump.

Moreover, a blower assembly 6*a* for bowing out humid air in the dishwasher in progress and a detergent box assembly 6*b* storing a detergent are provided to an inside of the door 6. And, a gasket (not shown in the drawing) is provided to an inner circumference of the door 6 to make the door adhere closely to cabinet 4 when the door 6 is closed.

Meanwhile, the upper and lower racks 10 and 12 are provided to move back and forth in the washing chamber 2. Specifically, wheels 12*a* are attached to a bottom of the lower rack 12 so that the lower rack 12 can be drawn outside the washing chamber 2 when the door 6 is fully open.

A plurality of first and second guide rollers 22*a* and 22*b* are provided to both sidewalls of the washing chamber 2, and a guide rail 24 is provided between of the first and second guide rollers 22*a* and 22*b* to slide back and forth. Moreover, a groove 24*a* is formed at the guide rail 24, and upper and one of lower rollers 26*a* and 26*b* fixed to upper and lower portions of each lateral side of the upper rack 10 is inserted in the corresponding groove 24*a*.

In this case, when the upper rack 10 is installed at a relatively low position in order to put large-sized tableware on the upper rack 10, the upper roller 26*a* is inserted in the groove 24*a* of the guide rail 24. When the upper rack 10 is installed at a relatively high position in order to put small-sized tableware on the upper rack 10, the lower roller 26*b* is inserted in the groove 24*a* of the guide rail 24.

However, in the related art dishwasher, the upper rack is taken off from the guide rail and then fitted thereto again in order to adjust the installation position of the upper rack, thereby causing inconvenience in use.

SUMMARY OF THE INVENTION

Accordingly, the present invention is directed to a dishwasher that substantially obviates one or more of the problems due to limitations and disadvantages of the related art.

An object of the present invention, which has been devised to solve the foregoing problem, lies in providing a dishwasher, by which installation height of a rack is adjusted inside a washing chamber and in which the installation height is automatically adjusted by a button.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a dishwasher including a washing chamber having tableware washed therein, a rack movably installed in the washing chamber to hold the tableware thereon, a plurality of guide rollers fixed to both confronting sidewalls of the washing chamber, a guide rail provided between the first and second rollers to slide back and forth, and a height adjustment means for moving the rack upward and downward, the height adjust means provided to slide on the guide rail.

In this case, the height adjust means includes a supporter fixing the rack thereto, a guide panel coupled to the supporter to guide upward and downward movement of the supporter, the guide panel coupled to slide on the guide rail, and first and second support parts formed at the supporter and the guide panel, respectively to fix the supporter to a predetermined portion of the guide panel.

And, the first support part includes a first fixing portion formed to be stepped at one upper side of the supporter and a second fixing portion protruding from a top end of the guide panel and being brought contact with the first fixing portion to stop the supporter when the supporter moves downward.

Moreover, the second support part includes a first incline portion having an upward incline plane at the guide panel and a second incline portion having a downward incline plane at one side of the supporter and sliding to be brought contact with the inline plane of the first incline portion to be caught on the first incline portion when the supporter moves upward.

In this case, the height adjust means further includes a button installed at the guide panel to push the supporter toward the rack to release the second incline portion caught on the first incline portion.

And, the supporter is formed of an elastic material to be elastically compressed by the button and to be elastically restored. Specifically, the supporter is formed of a plastic based material.

Meanwhile, a stopper is formed at the supporter and the guide panel so that the supporter is unable to further move upward when the second incline portion is caught on the first incline portion.

In this case, the stopper includes a first hook formed at the guide panel and a second hook formed at the supporter wherein the first and second hooks are locked to each other so that the supporter moving upward is unable to further move upward.

Meanwhile, a slot is formed at the guide rail and a roller inserted in the slot of the guide rail to slide is formed at the guide panel.

And, the rack includes a multitude of wires crossing to be connected to each other. A plurality of hooks are formed at the supporter to fix the upper lateral wires of the rack thereto. And, a plurality of protrusions are formed at the supporter to fix the lower lateral wire of the rack thereto.

In this case, each of the protrusions has a hook shape and is supported by a rib extending from the supporter.

And, the rib extends to an upper end of the protrusion to reinforce a rigidity of the protrusion.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
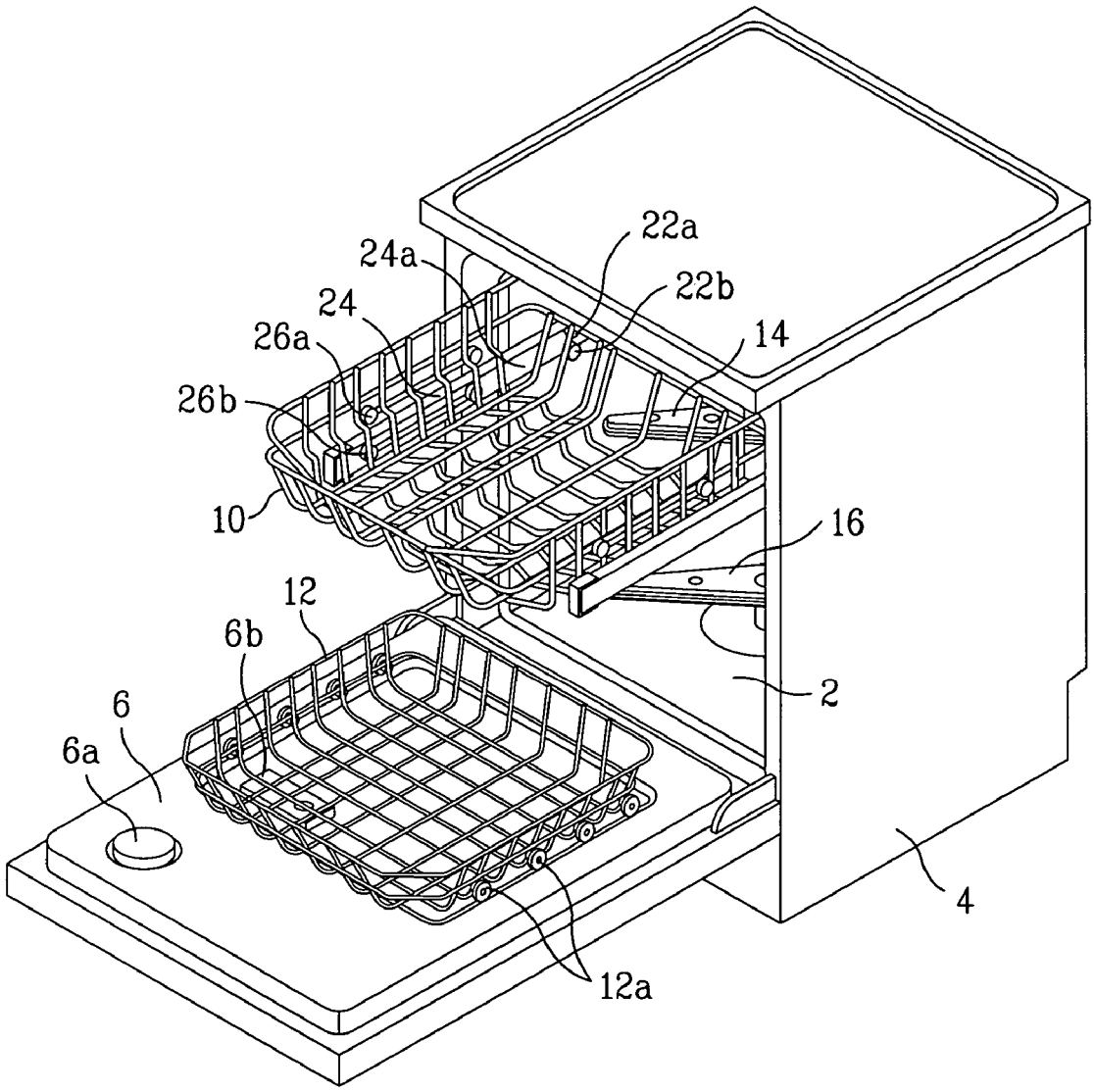
FIG. 1 is a perspective view of a dishwasher according to a related art.
Figure 2:
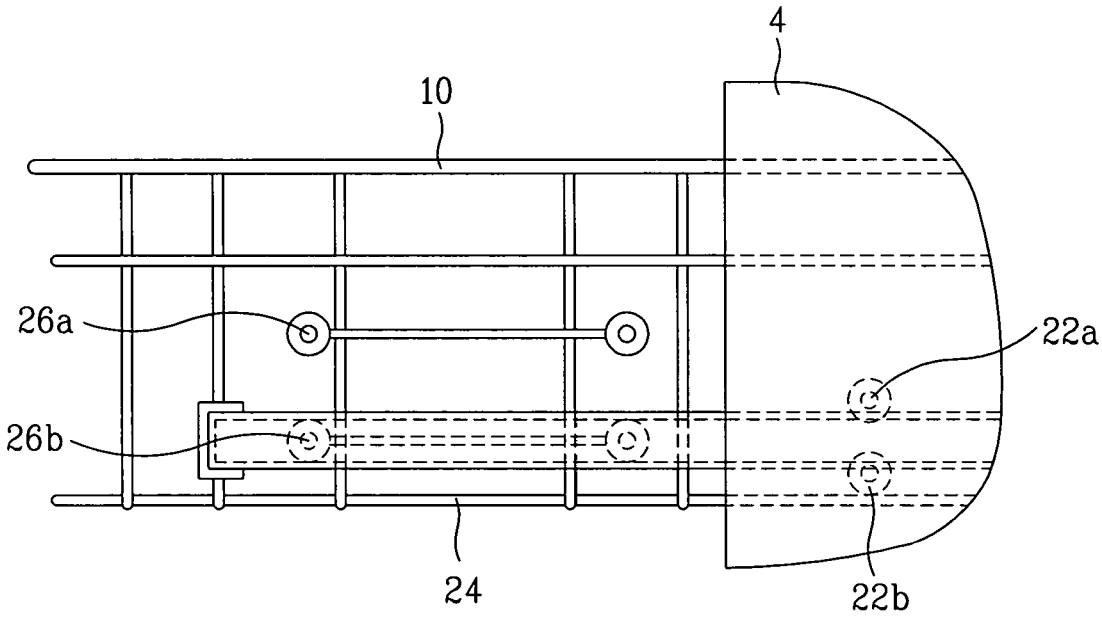
FIG. 2 is a cross-sectional view of a rack assembly of a dishwasher according to a related art.
Figure 3:
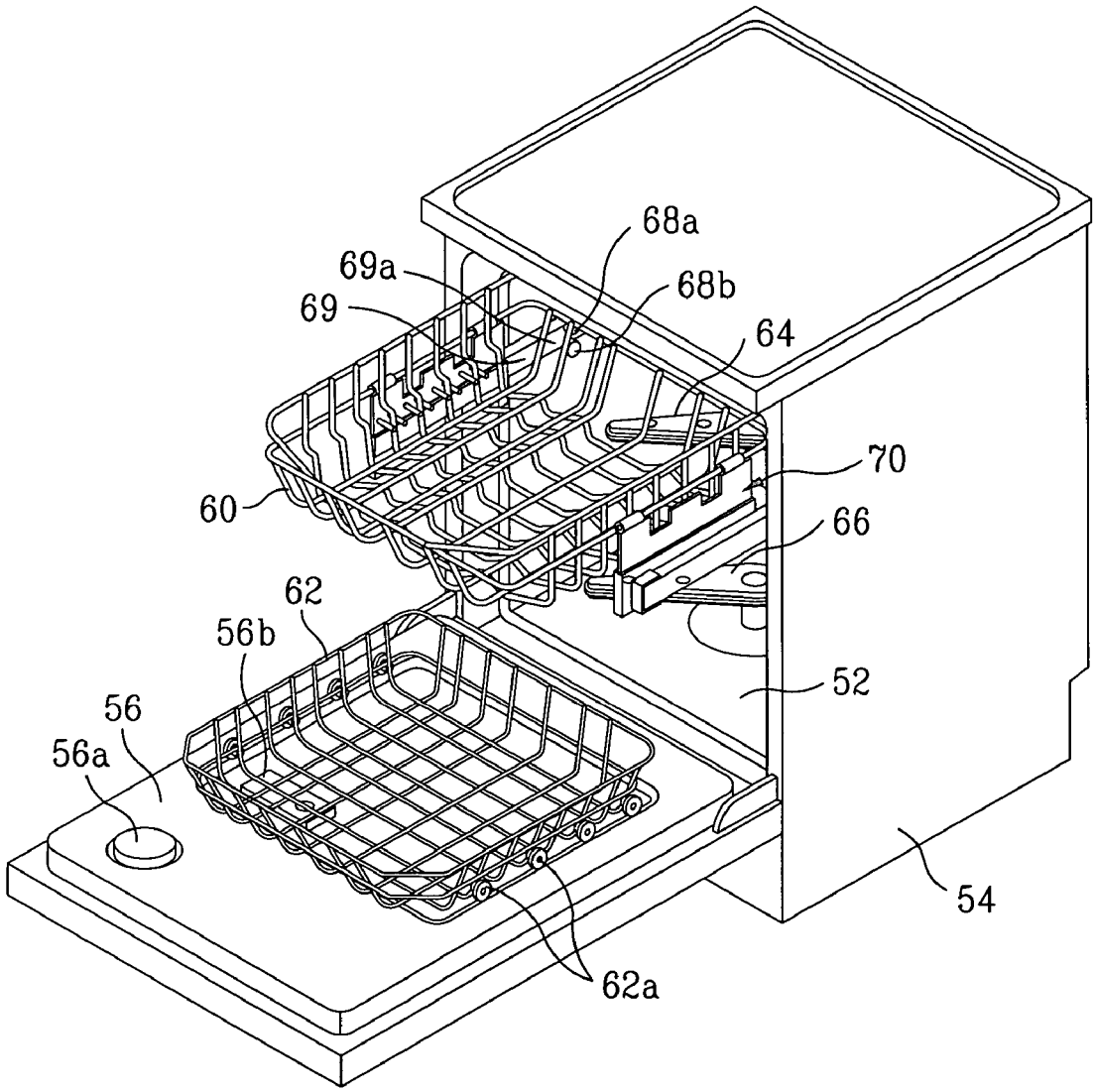
FIG. 3 is a perspective view of a dishwasher according to the present invention.

FIG. 3 is a perspective view of a dishwasher according to the present invention.

Referring to FIG. 3, a dishwasher according to the present invention mainly includes a cabinet 54 having a large open front side, a washing chamber 52 provided in the cabinet 54, and a door 56 opening closing the open front side of the cabinet 54.

Upper and lower racks 60 and 62 on which tableware is put are provided in the washing chamber 52, and top and bottom nozzles 64 and 66 injecting water via injection holes are rotatably provided under the upper and lower racks 60 and 62, respectively. Each of the upper and lower racks 60 and 62 is constructed with a multitude of wires crossing to be connected to each other to hold the tableware thereon.

A sump (not shown in the drawing) is provided under the washing chamber 52 to collect water therein. A pump (not shown in the drawing) pumping water to the top and bottom nozzles 64 and 66 and a heater assembly (not shown in the drawing) for heating water held in the sump are provided in the sump.

Moreover, a blower assembly 56*a* for blowing out humid air in the dishwasher in progress and a detergent box assembly 56*b* storing a detergent are provided to an inside of the door 56. And, a gasket (not shown in the drawing) is provided to an inner circumference of the door 56 to make the door 56 adhere closely to cabinet 54 when the door 56 is closed.

Meanwhile, the upper and lower racks 60 and 62 are provided to move back and forth in the washing chamber 52. Specifically, wheels 62*a* are attached to a bottom of the lower rack 62 so that the lower rack 62 can be drawn outside the washing chamber 52 when the door 56 is fully open.

A plurality of first and second guide rollers 68*a* and 68*b* are provided to both sidewalls of the washing chamber 52, and a guide rail 69 is provided between of the first and second guide rollers 68*a* and 68*b* to slide back and forth.

Moreover, a height adjustment means 70 is provided to the upper rack 60. The height adjustment means 70 is provided to slide in the guide rail 69 to move the upper rack 60 upward and downward.

Of course, the height adjustment means 70 can be provided to the lower rack 62 or to both of the upper and lower racks 60 and 62. For the convenience of describing the dishwasher according to the present invention, the height adjustment means 70 is provided to the upper rack 60 only.

Figure 4:
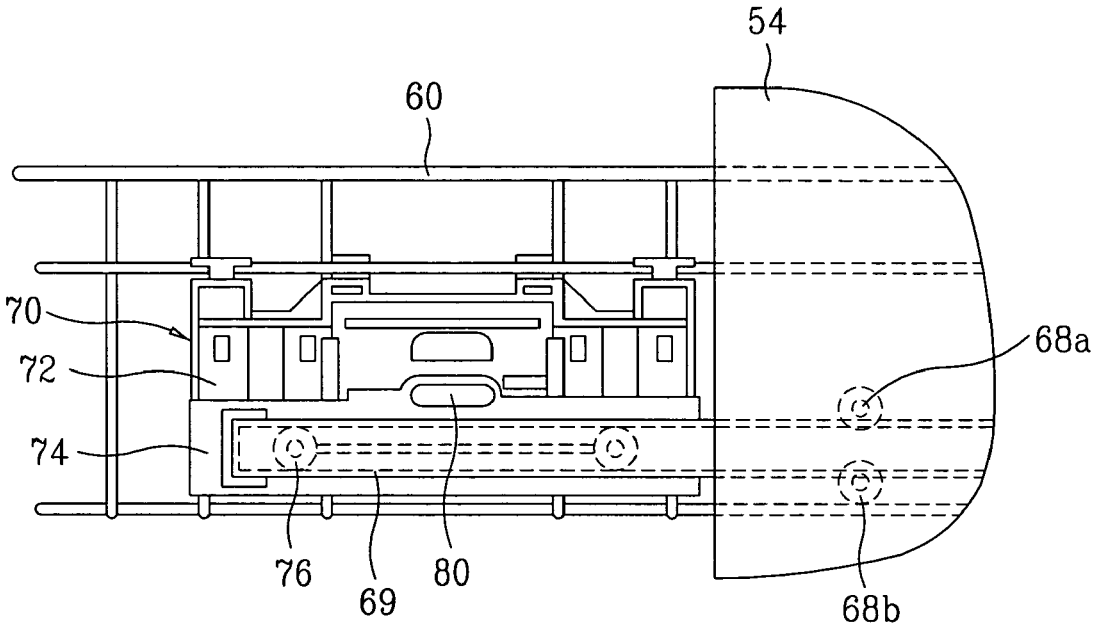
FIG. 4 is a cross-sectional view of a rack assembly of a dishwasher according to the present invention.
Figure 5:
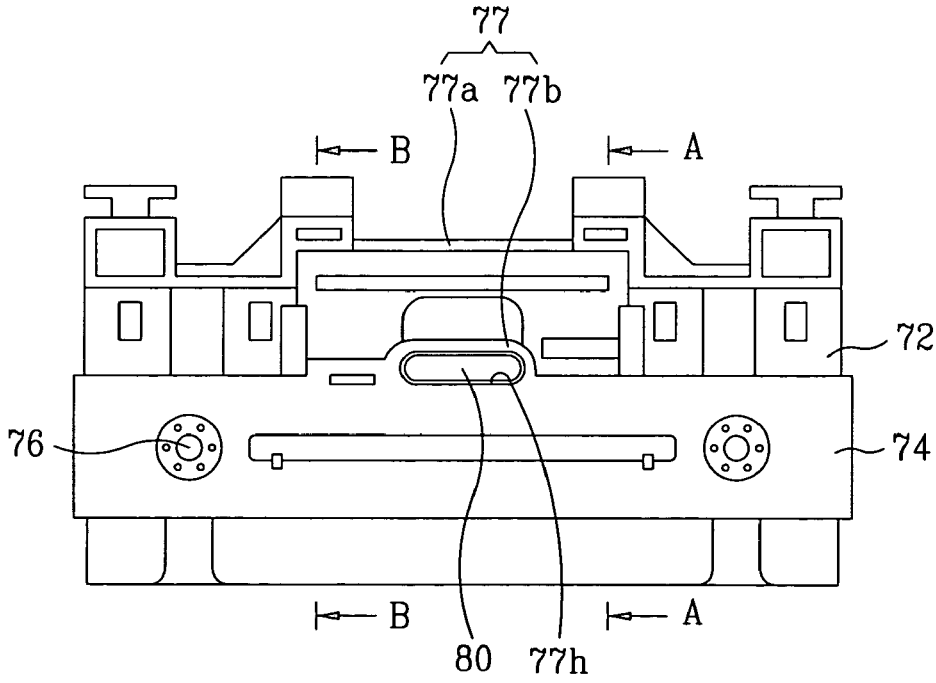
FIG. 5 is a front view of a height adjustment means according to the present invention.
Figure 6:
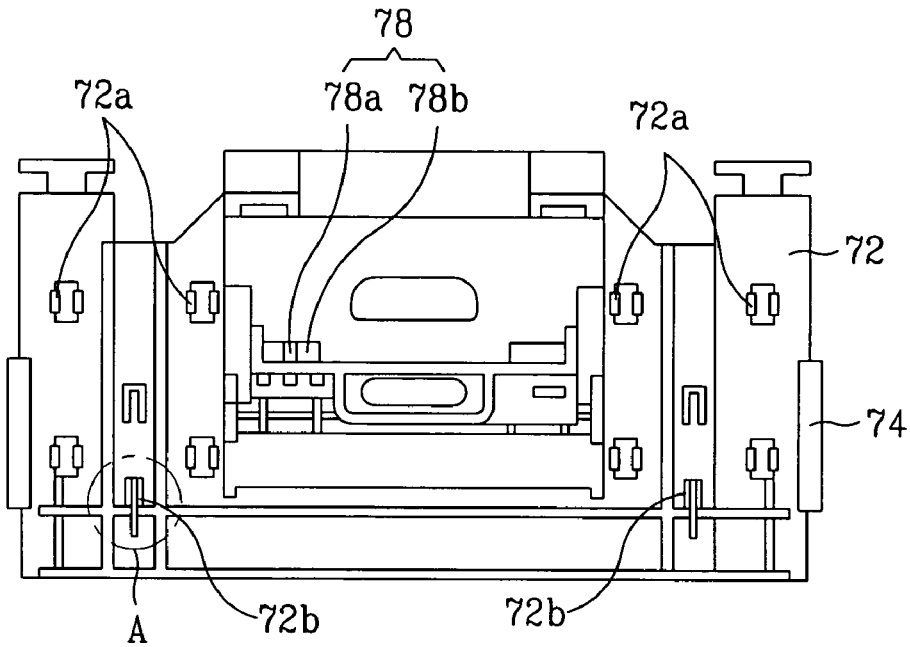
FIG. 6 is a rear view of a height adjustment means according to the present invention.

FIG. 4 is a cross-sectional view of a rack assembly of a dishwasher according to the present invention, FIG. 5 is a front view of a height adjustment means according to the present invention, and FIG. 6 is a rear view of a height adjustment means according to the present invention.

Referring to FIG. 4 to FIG. 6, the height adjustment means 70 includes a guide panel 74, a supporter 72, and first and second support parts 77 and 78.

The guide panel 74 is coupled to the guide rail 69 to slide therein. For this, rollers 76 inserted to slide in a slot 69*a* (cf. FIG. 3) are provided to both sides of the guide panel 74. Moreover, the guide panel 74 is installed to enclose the supporter 72 to guide upward/downward movement of the supporter 72.

The supporter 72 is coupled to the upper rack 60 to fix thereto. For this, a plurality of hooks 72*a* fixing upper lateral wires of the upper rack 60 thereto and a plurality of protrusions 72*b* fixing a lower lateral wire thereto are provided to the supporter 72.

Figure 7:
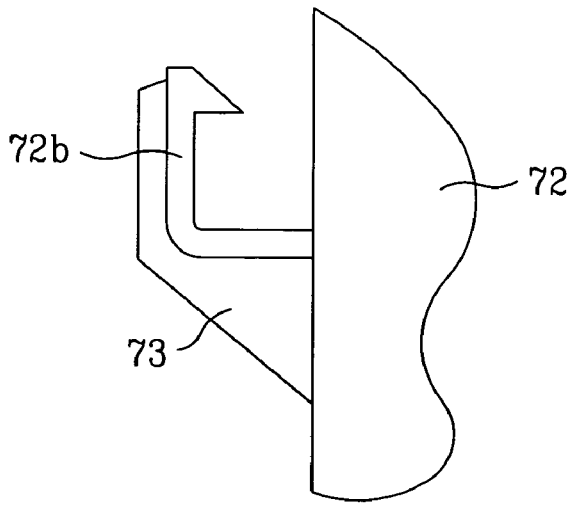
FIG. 7 is a magnified view of 'A' in FIG. 6.

FIG. 7 is a magnified view of 'A' in FIG. 6.

The protrusion 72*b*, as shown in FIG. 7, has a hook shape and is supported by a rib 73 extending from the supporter 72. The rib 73 preferably extends to a top end of the protrusion 72*b* to reinforce a rigidity of the protrusion 72*b*.

And, the first and second support parts 77 and 78 are formed at the support 72 and the guide panel 74, respectively to fix the supporter 72 to a predetermined spot of the guide panel 74.

Figure 8:
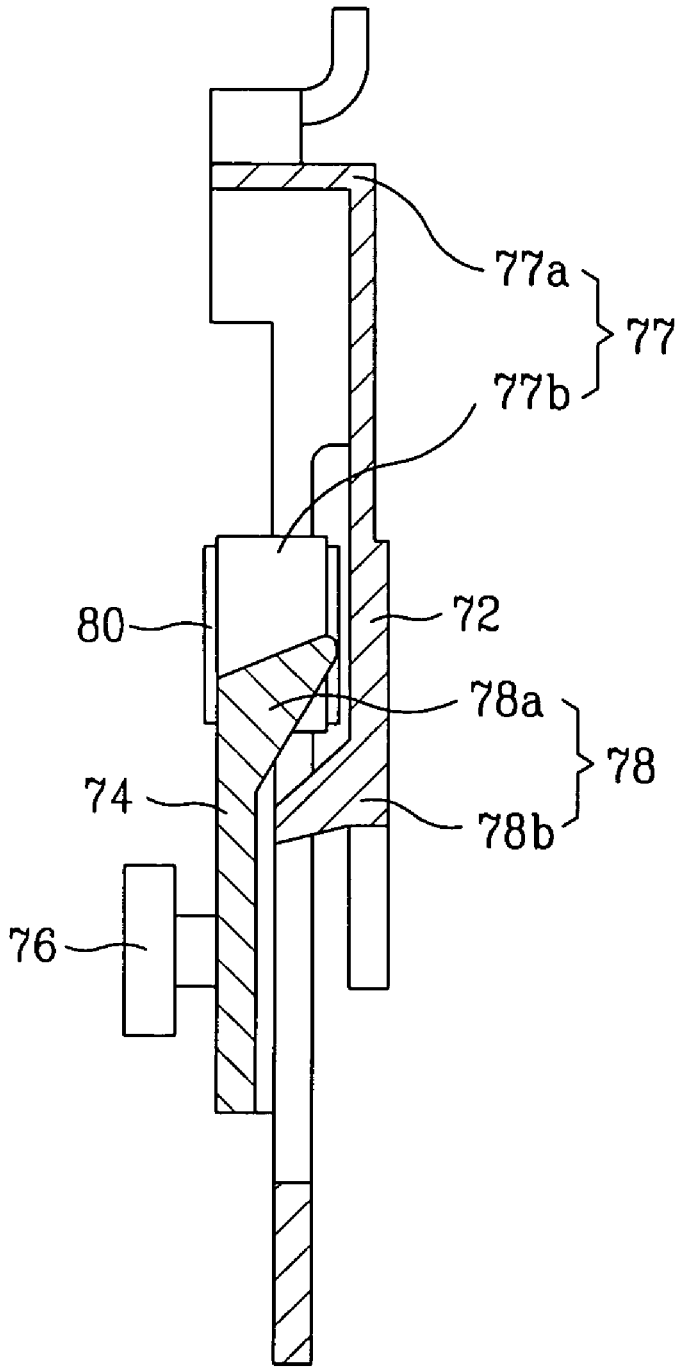
FIG. 8 is a cross-sectional according to a bisecting line A-A in FIG. 5.

FIG. 8 is a cross-sectional according to a bisecting line A-A in FIG. 5, in which the first and second support parts 77 and 78 are shown in detail.

The first support part 77, as shown in FIG. 8, includes a first fixing portion 77*a* formed to be stepped at one upper side of the supporter 72 and a second fixing portion 77*b* protruding from a top end of the guide panel 74.

When the supporter 72 moves downward, the first fixing portion 77*a* is caught on the second fixing portion 77*b* so that the supporter 72 is unable to further move downward. Hence, the supporter 72 moves downward for a while and then stops at a predetermined height if the first fixing portion 77*a* is caught on the second fixing portion 77*b*.

And, the second support part 78 includes a first incline portion 78*a* having an upward incline plane at the guide panel 74 and a second incline portion 78*b* having a downward incline plane at one side of the supporter 72.

Figure 10A:
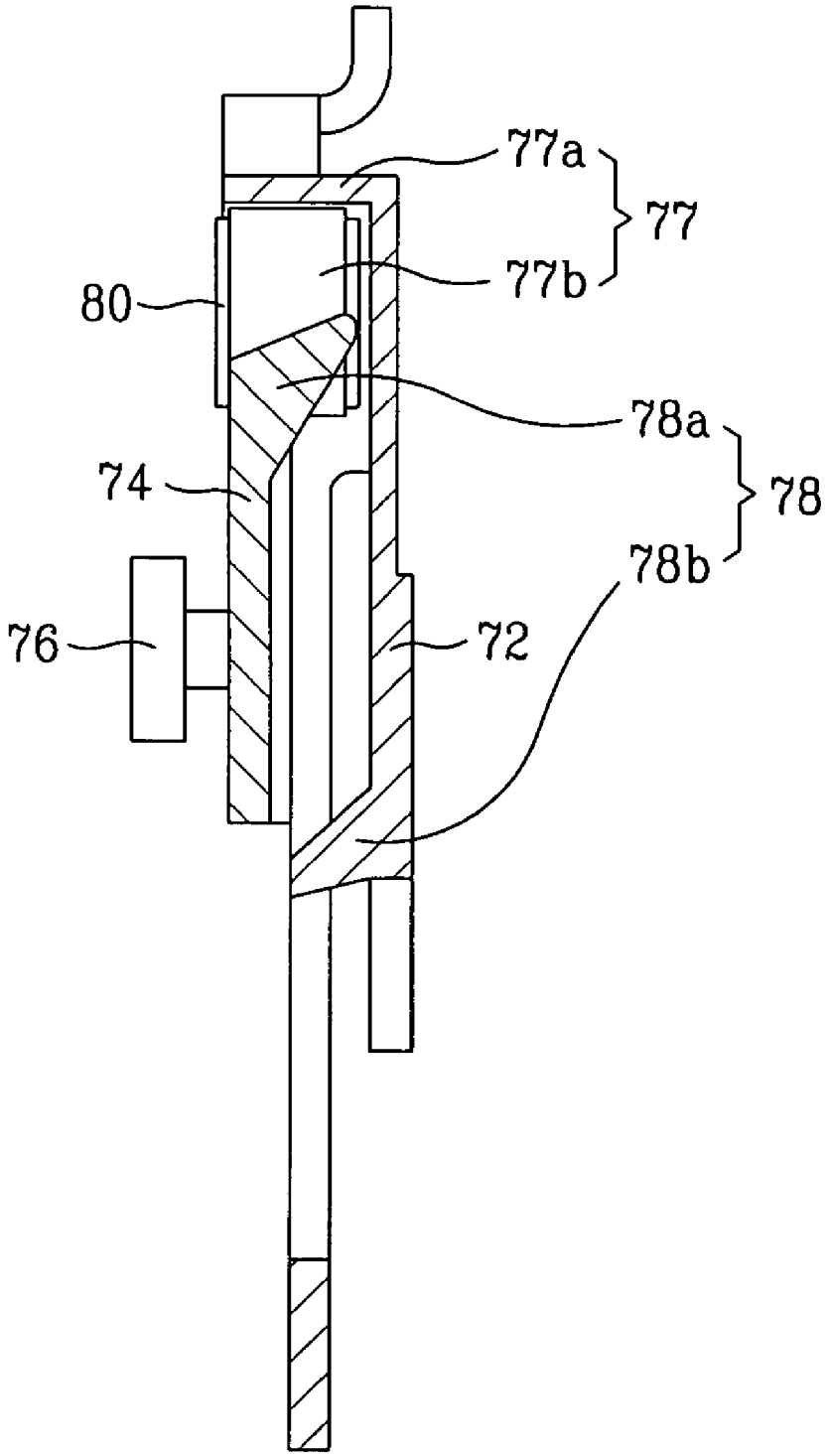
FIGS. 10A to 10F are diagrams of a height adjustment means of a dishwasher according to the present invention, in which operation states of the height adjustment means are shown.
Figure 10B:
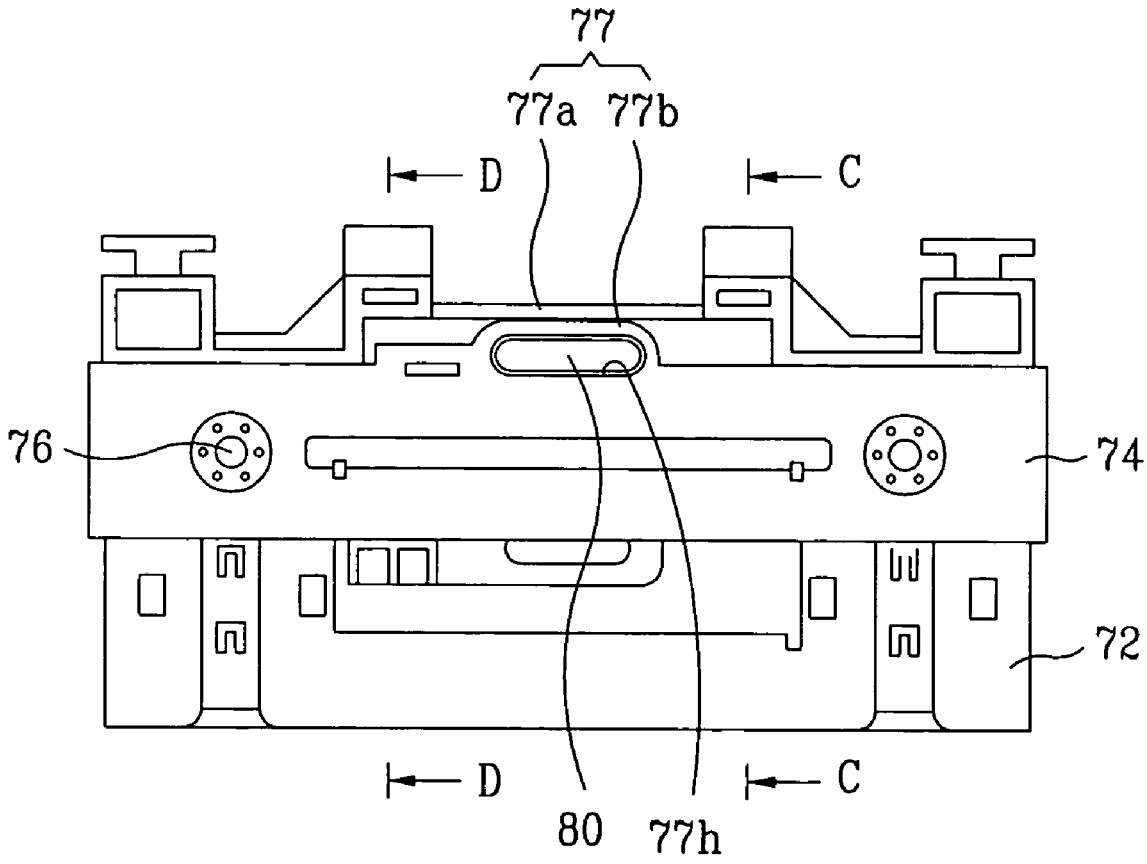
Figure 10C:
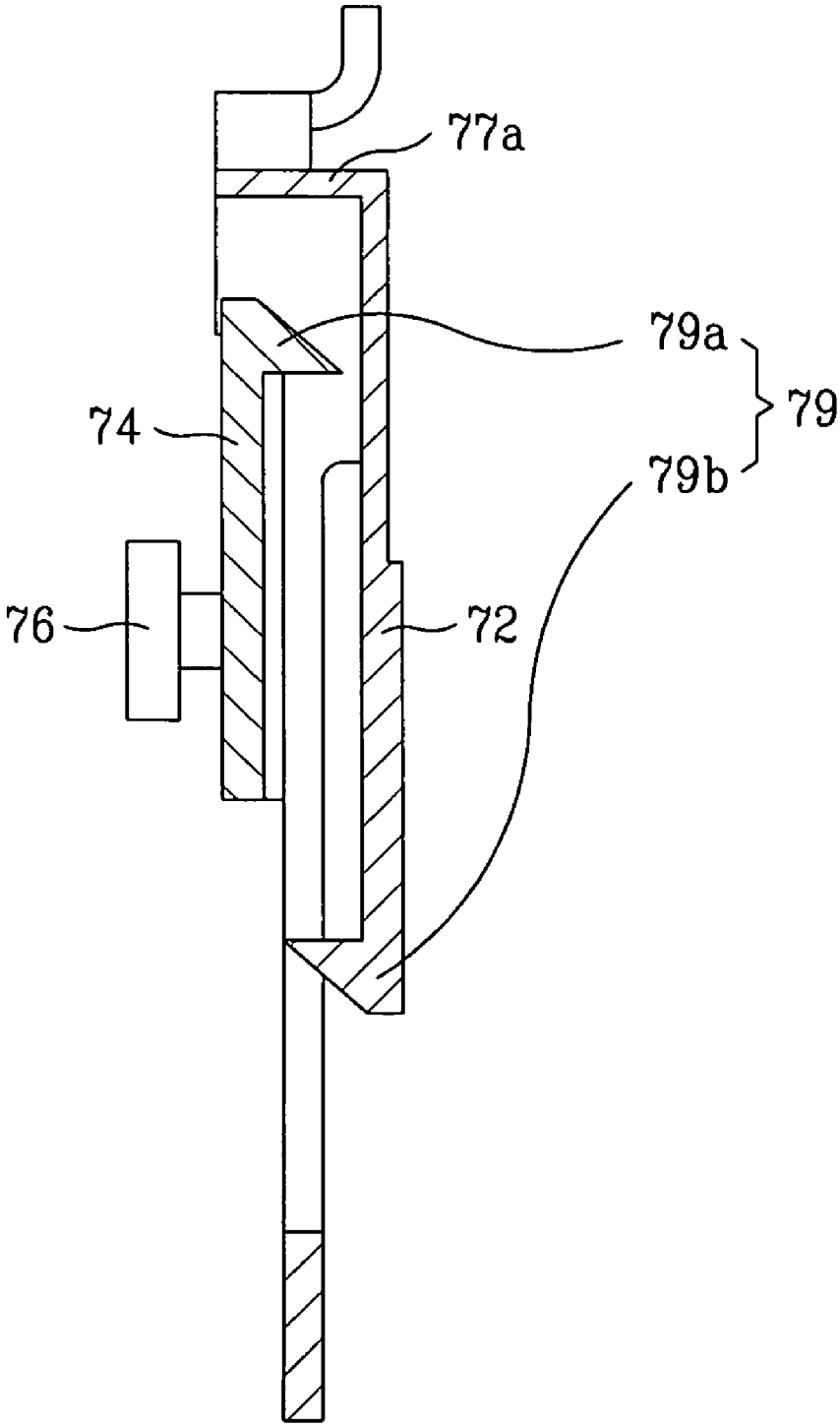
Figure 10D:
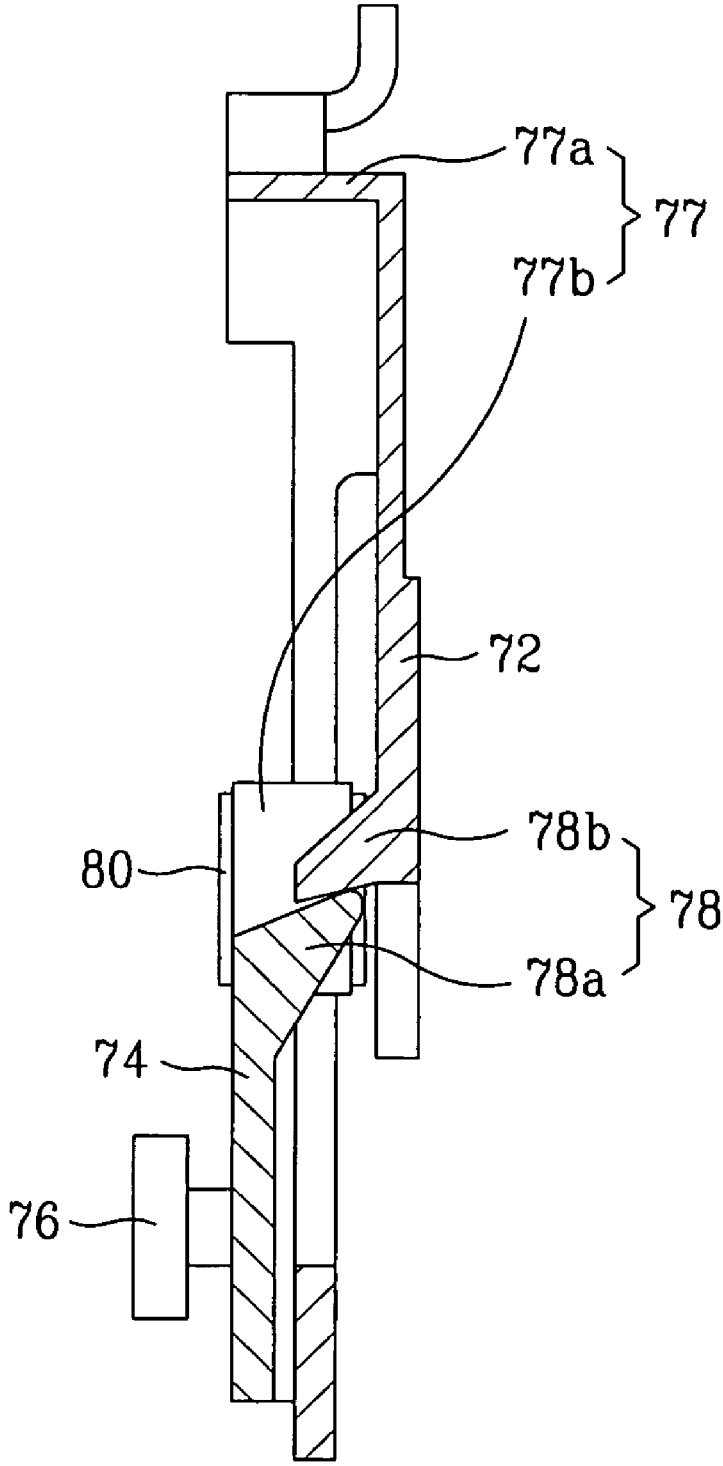

When the supporter 72 moves upward, the second incline portion 78*b* is brought sliding contact with the inline plane of the first incline portion 78*a* and is then positioned over the first incline portion 78*a* (cf. FIG. 10D).

Hence, the second incline portion 78*b* is caught on the first incline portion 78*a* to prevent the supporter 72 from moving downward again. Thus, the supporter 72 moves to upward to a predetermined height to stop until the second incline portion 78*b* is disposed onto the first incline portion 78*a*.

Besides, the first and second support parts 77 and 78 are explained in detail when an operation of the dishwasher is described as follows.

Figure 9:
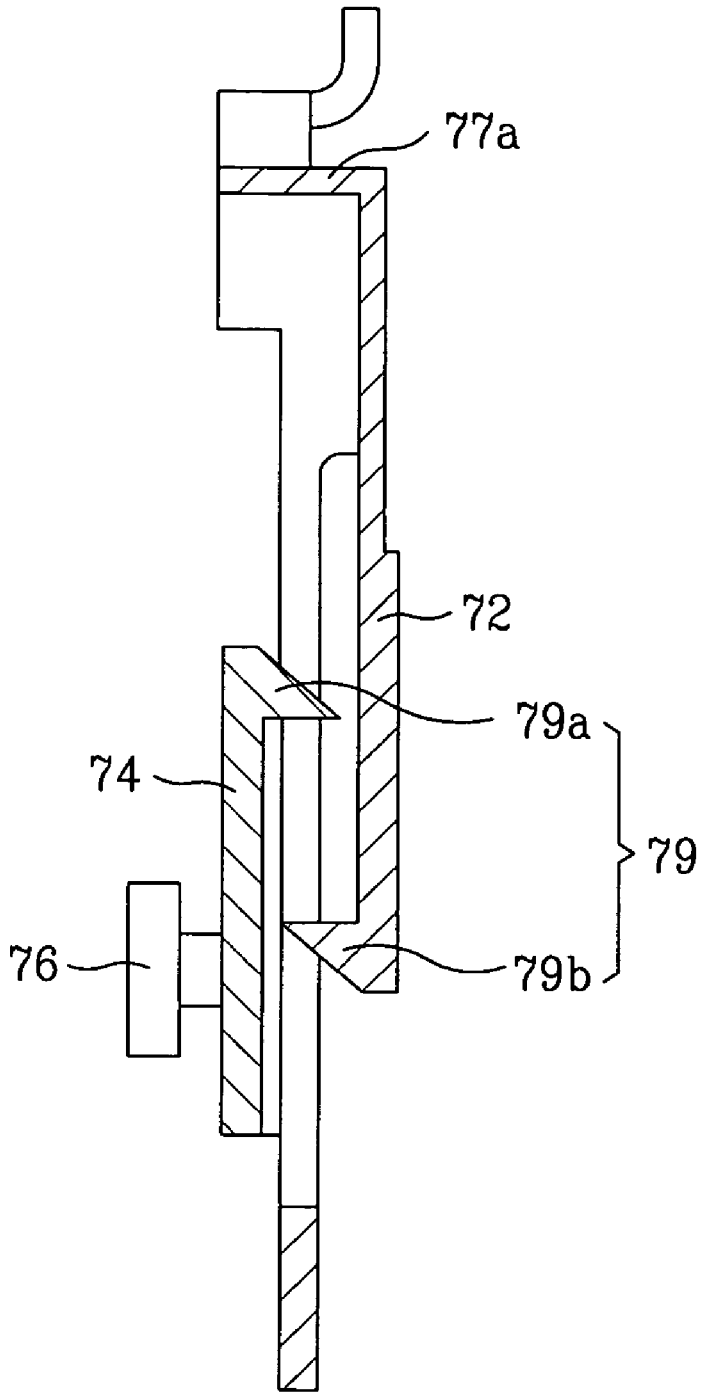
FIG. 9 is a cross-sectional according to a bisecting line B-B in FIG. 5.

FIG. 9 is a cross-sectional according to a bisecting line B-B in FIG. 5.

Referring to FIG. 9, a stopper 79 is formed at the supporter 72 and the guide panel 74 so that the supporter 72 moving upward cannot further move upward when the second incline portion 78*b* is caught on the first incline portion 78*a*.

The stopper 79 includes a first hook 79*a* formed at the guide panel 74 and a second hook 79*b* formed at the supporter 72. The first and second hooks 79*a* and 79*b* are locked to each other so that the supporter 72 is unable to move upward any more.

Meanwhile, the height adjustment means 70 further includes a button 80 installed at the guide panel 74 to release the lock between the first and second incline portions 78*a* and 78*b*.

The button 80, as shown in FIG. 5 and FIG. 8, is inserted in a hole 77*h* formed at a center of the second fixing portion 77*b* to be contacted with the supporter 72 or to leave a predetermined interval from the supporter 72.

Hence, if a user presses the button 80, the button 80 pushes a portion of the supporter 72 where the second incline portion 78*b* is formed so that the first and second inline portions 78*a* and 78*b* are unlocked.

In this case, the supporter 72 is preferably formed of an elastic material to be elastically compressed by the button 80 and to be restored. Specifically, the supporter 72 is formed of a plastic based material. Moreover, the guide panel 74 is preferably formed of an elastic material as well.

An operation of the above-constructed dishwasher is explained as follows.

FIGS. 10A to 10F are diagrams of a height adjustment means of a dishwasher according to the present invention, in which operation states of the height adjustment means are shown.

First of all, the upper lateral wires of the upper rack 60 are inserted to be fixed between a plurality of the hooks 72*a* formed on a rear side of the supporter 72, and the lower lateral wire of the upper rack 60 is inserted to be fixed to the protrusions 72*b* at the lower rear side of the supporter 72.

And, the guide rail 69 is installed to slide between the first and second guide rollers 68*a* and 68*b* fixed to both sides of the washing chamber 52, and the roller 76 fixed to the guide panel 74 is inserted in the slot 69*a* of the guide rail 69.

Once the upper rack 60 is installed inside the washing chamber 52, the weight of the upper rack 60 makes the supporter 72 move downward by gravity. In this case, the fixing portion 77*a* at the supporter 72, as shown in FIG. 10A, is caught on the second fixing portion 77*b* at the guide panel 74 so that the supporter 72 is unable to further move downward.

The supporter 72, as shown in FIG. 10B, is caught on the upper part of the guide panel 74 to stop moving, and the upper rack 60 fixed to the supporter 72 descends together with the supporter 72 to a predetermined height to stop. Hence, a position of the upper rack 60 is lowered.

Moreover, the first and second hooks 79*a* and 79*b* of the first stopper 79, as shown in FIG. 10C maintains to leave a predetermined distance from each other.

Subsequently, when a user lifts the upper rack 60 upward, both of the upper rack 60 and the supporter 72 move upward so that the second incline portion 78*b* slides to be brought contact with the incline plane of the first incline portion 78*a*. The second incline portion 78*b* is then disposed over the first incline portion 78*a*.

In this case, even if the supporter 72 is pushed downward by the weight of the upper rack 60, the second incline portion 78*b* of the supporter 72 is caught on the first incline portion 78*a* of the guide panel 74 so that the support 72 is unable to further move downward.

Figure 10E:
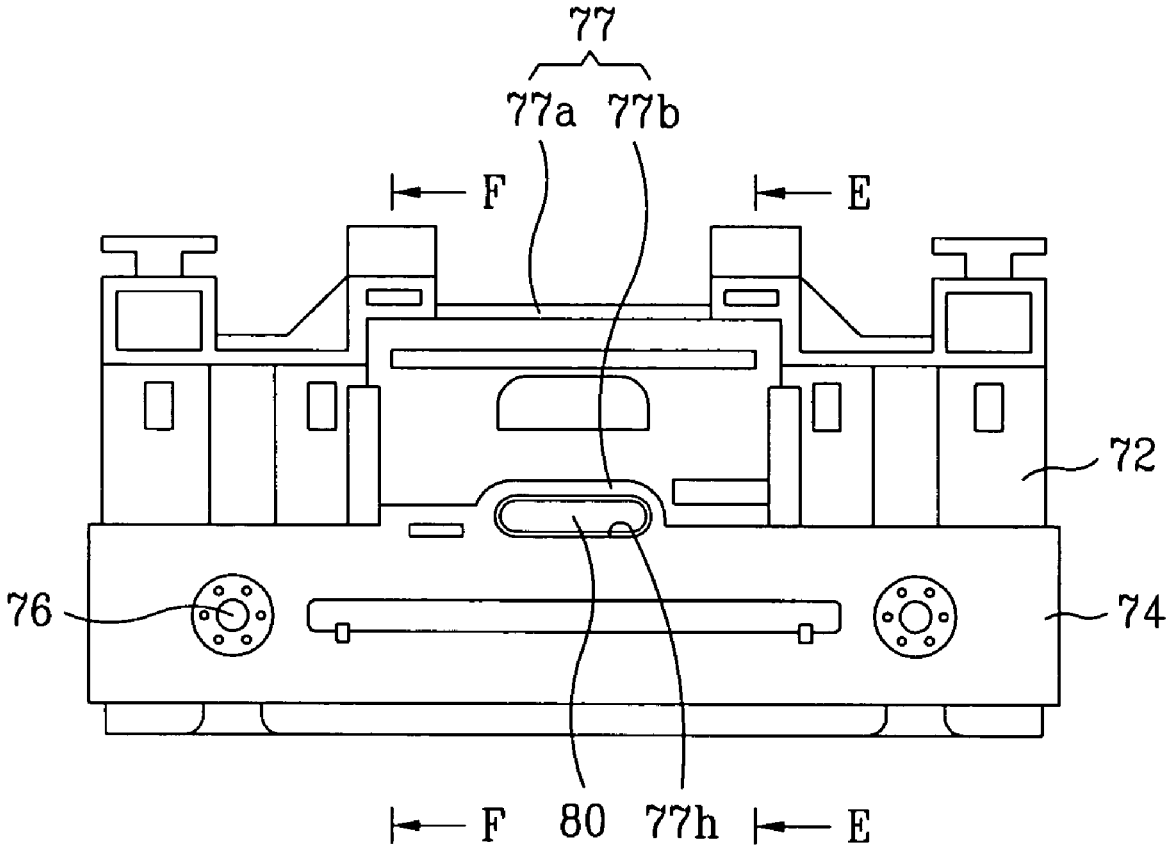

The supporter 72, as shown in FIG. 10E, is held by the lower side of the guide panel 74 to stop moving, and the upper rack fixed to the supporter 72 ascends together with the supporter 72 to a predetermined height to stop. Hence, the position of the upper rack 60 is raised.

Figure 10F:
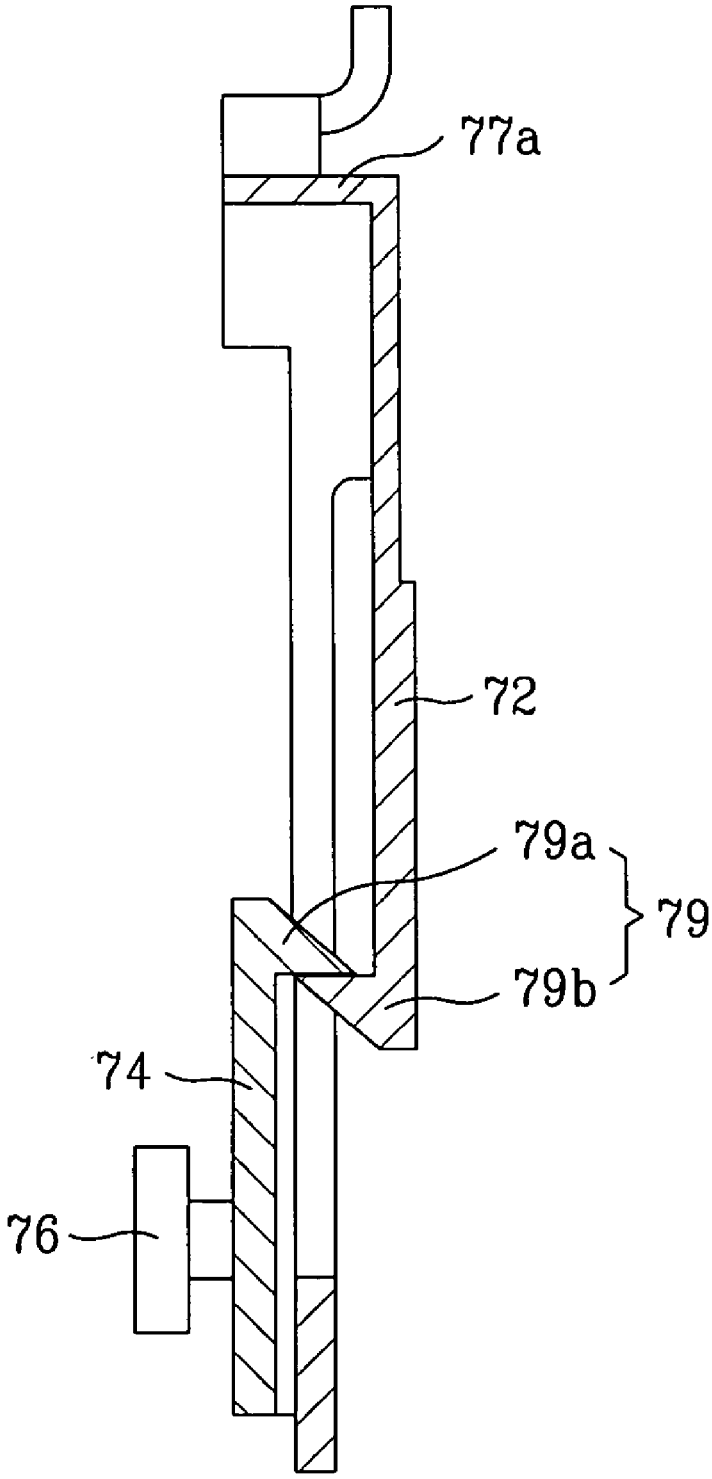

Moreover, when the second incline portion 78*b* is caught on the first incline portion 78*a* as the supporter 72 ascends over the predetermined height, the second hook 79*b* of the supporter 72, as shown in FIG. 10F ,is locked to the first hook 79*a* of the guide panel 74 so that the supporter 72 is unable to further move upward.

Meanwhile, once the user presses the button 80 while the second incline portion 78*b* is caught on the first incline portion 78*a*, the button 80 pushes the supporter 72 to widen the gap between the supporter 72 and the guide panel 74 so that the second and first incline portions 78*b* and 78*a* are released from each other.

In this case, as the first incline portion 78*a* of the guide panel 74 slides to be brought contact with the incline plane of the second incline portion 78*b* of the supporter 72 so that the supporter 72 moves downward.

Thereafter, as explained in the foregoing description, the first fixing portion 77*a* of the supporter 72 is caught on the second fixing portion 77*b* of the guide panel 74, whereby the position of the upper rack 60 is lowered.

Accordingly, the dishwasher according to the present invention has the following advantages or effects.

First of all, the rack is moved upward and downward by the height adjustment means, thereby causing no inconvenience of loading/unloading the rack on/from the guide rail to adjust the installation position.

Secondly, the button pressed by the user enables the rack to lie on a relatively low position. And, the rack is lifted by the user to lie on a relatively high position. Thus, the installation height of the rack is conveniently adjusted. Therefore, the present invention facilitates to simply adjust the installation height of the rack with less effort.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A dishwasher, comprising:

a washing chamber in which tableware is washed;

a rack movably installed in the washing chamber to hold the tableware therein;

a plurality of guide rollers fixed to both confronting sidewalls of the washing chamber;

a guide rail provided between the plurality of guide rollers configured to slide back and forth; and a height adjustment device configured to move the rack upward and downward, the height adjustment device provided to slide on the guide rail, wherein the height adjustment device comprises:

a supporter that fixes the height adjustment device to the rack;

a guide panel coupled to the supporter to guide upward and downward movement of the supporter, the guide panel coupled to slide on the guide rail;

first and second support parts formed at the supporter and the guide panel, respectively, to fix the supporter to a predetermined portion of the guide panel, wherein the second support part comprises:

a first incline portion having an upward incline plane at the guide panel; and a second incline portion having a downward incline plane at one side of the supporter, the second incline portion sliding to be brought into contact with the incline plane of the first incline portion to be seated upon the first incline portion when the supporter moves upward and, wherein a stopper is formed at the supporter and the guide panel so that the supporter is unable to further move upward when the second incline portion to be seated upon the first incline portion; and a button installed at the guide panel to push the supporter toward the rack to release the second incline portion to be seated upon the first incline portion.

2. The dishwasher as claimed in claim 1, wherein the first support part comprises:

a first fixing portion formed to be stepped at one upper side of the supporter; and a second fixing portion protruding from a top end of the guide panel, the second fixing portion being brought into contact with the first fixing portion to stop the supporter when the supporter moves downward.

3. The dishwasher as claimed in claim 1, wherein the supporter is formed of an elastic material to be elastically compressed by the button and to be elastically restored.

4. The dishwasher as claimed in claim 3, wherein the supporter is formed of a plastic based material.

5. The dishwasher as claimed in claim 1, wherein the stopper comprises:

a first hook formed at the guide panel; and a second hook formed at the supporter, wherein the first and second hooks are locked to each other so that the supporter moving upward is unable to further move upward.

6. The dishwasher as claimed in claim 1, wherein a slot is formed at the guide rail and a roller inserted in the slot of the guide rail to slide is formed at the guide panel.

7. The dishwasher as claimed in claim 1, wherein the rack comprises a multitude of wires crossing to be connected to each other and wherein a plurality of hooks are formed at the supporter to fix the upper lateral wires of the rack thereto.

8. The dishwasher as claimed in claim 1, wherein a plurality of protrusions are formed at the supporter to fix the lower lateral wire of the rack thereto.

9. The dishwasher as claimed in claim 8, wherein each of the protrusions has a hook shape and is supported by a rib extending from the supporter.

10. The dishwasher as claimed in claim 9, wherein the rib extends to an upper end of the protrusion to reinforce a rigidity of the protrusion.

11. A height adjustment device for a dishwasher, the dishwasher having a washing chamber in which tableware is washed, a rack movably installed in the washing chamber to hold the tableware therein, a plurality of guide rollers fixed to both confronting sidewalls of the washing chamber, and a guide rail provided between the plurality of guide rollers configured to slide back and forth, the height adjustment device being configured to move the rack up and down and to slide on the guide rail and comprising:

a supporter that fixes the height adjustment device to the rack; and a guide panel coupled to the supporter to guide upward and downward movement of the supporter, the guide panel coupled to slide on the guide rail;

first and second support parts formed at the supporter and the guide panel, respectively, to fix the supporter to a predetermined portion of the guide panel, wherein the second support part comprises:

a first incline portion having an upward incline plane at the guide panel; and a second incline portion having a downward incline plane at one side of the supporter, the second incline portion sliding to be brought into contact with the incline plane of the first incline portion to be seated upon the first incline portion when the supporter moves upward, and wherein a stopper is formed at the supporter and the guide panel so that the supporter is unable to further move upward when the second incline portion to be seated upon the first incline portion; and a button installed at the guide panel to push the supporter toward the rack to release the second incline portion to be seated upon the first incline portion.

12. The height adjustment device as claimed in claim 11, wherein the first support part comprises:

a first fixing portion formed to be stepped at one upper side of the supporter; and a second fixing portion protruding from a top end of the guide panel, the second fixing portion being brought into contact with the first fixing portion to stop the supporter when the supporter moves downward.

13. The height adjustment device as claimed in claim 11, wherein the supporter is formed of an elastic material to be elastically compressed by the button and to be elastically restored.

14. The height adjustment device as claimed in claim 11, wherein the supporter is formed of a plastic based material.

15. The height adjustment device as claimed in claim 11, wherein the stopper comprises:

a first hook formed at the guide panel; and a second hook formed at the supporter, wherein the first and second hooks are locked to each other so that the supporter moving upward is unable to further move upward.

16. The height adjustment device as claimed in claim 11, wherein a slot is formed at the guide rail and a roller inserted in the slot of the guide rail to slide is formed at the guide panel.

17. The height adjustment device as claimed in claim 11, wherein the rack comprises a multitude of wires crossing to be connected to each other and wherein a plurality of hooks are formed at the supporter to fix the upper lateral wires of the rack thereto.

18. The height adjustment device as claimed in claim 11, wherein a plurality of protrusions are formed at the supporter to fix the lower lateral wire of the rack thereto.

19. The height adjustment device as claimed in claim 18, wherein each of the protrusions has a hook shape and is supported by a rib extending from the supporter.

20. The height adjustment device as claimed in claim 19, wherein the rib extends to an upper end of the protrusion to reinforce a rigidity of the protrusion.

* * * * *